United States Patent [19]

Dotterweich et al.

[11] Patent Number: 5,026,101

[45] Date of Patent: Jun. 25, 1991

[54] PUSH-PULL OR TWIST DOOR KNOB/HANDLE MECHANISM

[76] Inventors: John E. Dotterweich, 512 Teakwood Drive, Lanoka Harbor, N.J. 08734; Stephen B. Demick, 68 Cedar Avenue, West End, N.J. 07740

[21] Appl. No.: 516,036

[22] Filed: Apr. 27, 1990

[51] Int. Cl.[5] ..... E05C 1/12

[52] U.S. Cl. ..... 292/166; 292/170

[58] Field of Search ..... 292/166, 170, 336.3, 292/350, 337, 174

[56] References Cited

U.S. PATENT DOCUMENTS

| | | | |
|---|---|---|---|
| 397,226 | 2/1889 | Aguero | 292/166 |
| 618,708 | 1/1897 | Merwin | 292/170 |
| 908,361 | 12/1908 | Vredenburgh | 292/166 |
| 1,991,822 | 2/1935 | Snipes | 292/166 |
| 3,385,622 | 5/1968 | Winger | 292/170 |
| 3,490,803 | 1/1970 | Rollins | 292/170 |
| 3,582,121 | 9/1969 | Rollins | 292/170 |
| 4,728,133 | 3/1988 | Valley | 292/350 |
| 4,777,810 | 10/1988 | Webster | 292/170 |

FOREIGN PATENT DOCUMENTS

| | | | |
|---|---|---|---|
| 465399 | 5/1950 | Canada | 292/166 |

*Primary Examiner*—Eric K. Nicholson

*Attorney, Agent, or Firm*—Mathews, Woodbridge & Collins

[57] ABSTRACT

An improved door knob/handle mechanism is described which opens, i.e. unlatches, the door through the mechanism of pushing, pulling or twisting the door knob/handle. When the door panel is to be opened in a direction so as to swing-away from the user, the door is opened either by pushing on the knob/handle, or twisting it. When the door panel is to open in a direction by swinging towards the user, the door is opened either by pulling the knob/handle or twisting it. The improved mechanism facilitates the opening of a door by those individuals who may be handicapped, suffer from arthritis, or have their hands filled while attempting to open the door, either inwardly, or outwardly.

9 Claims, 2 Drawing Sheets

PUSH-PULL OR TWIST DOOR KNOB/HANDLE MECHANISM

This Application is the subject of a Disclosure Document received on Dec. 7, 1989, and identified by No. 241154.

FIELD OF THE INVENTION

This invention relates to mechanisms for opening internal or external doors and, more particularly, to a door knob/handle mechanism which permits opening of the door through the medium of pushing, pulling or twisting the door knob/handle.

DESCRIPTION OF THE PRIOR ART

As is well known and understood, the great majority of doors found in the home or office facility are of the type that are rotary operated, i.e, the latch bolt is caused to be retracted by imparting a twist action to the door knob. Such twist motion generally imparts a rotary action to the latch bolt, and is the same whether the door is to be opened from the outside, i.e., by swinging the door inwardly of the room, or whether the door is opened from inside the room, by swinging the door inwardly towards the user.

As is also well known and understood, opening of these doors by a twist-motion to the knob oftentimes presents difficulties, especially to those who are handicapped, or suffer from any form of arthritis of the hands, or simply by those whose hands are filled, or otherwise encumbered. Some suggestions to accommodate those users revolve around the replacement of the twist action door knob with a special latch mechanism, whereby a push-or-pull force becomes available to effectuate the motion to operate the rotary actuated latch. Further suggestions concern an entirely different push-pull mechanism to permit the opening and closure of the door. By and large, however, all of these alternatives proved to be much more burdensome to install—and had very little usefulness as a simple replacement for doors that already existed in the home or office room where such entry was to be governed. In other words, such suggestions could not just be simply purchased, and installed to replace the existing door knob/handle mechanism, but various cut-outs to the door or door housing had to be made in order to effectuate the conversion.

SUMMARY OF THE INVENTION

As will become clear hereinafter, the present invention provides a simple mechanism to convert a twist-operated door opening mechanism into one which also provides a push-pull operation, all to be installed as a simple replacement for the arrangement already existing. As will also be seen, the described mechanism continues to provide rotary actuation of the latch mechanism, whether the door knob/handle be pushed, pulled or twisted to accommodate all types of users. As also will be appreciated, the mechanism of the invention will be seen to employ a minimum number of parts, is compact, lightweight, inexpensive to manufacture, and from all intents and purposes comprises the exact same door knob/handle mechanism that typically is provided on internal or external door constructions today, except that the internal workings of the mechanism is modified.

In particular, the latch bolt is employed, along with its bevelled extended end, in conventional manner to be urged into an extended position by a member mounted through the body of the lock acting upon an included spring. In accordance with conventional constructions, such member is "turnable" so as to retract the bolt—but, in accordance with the invention, is also "pushable" and "pullable" to provide a linear motion which also actuates the bolt to its retracted position. As will become more specifically clear from a consideration of the following description, such member—in a preferred embodiment of the invention —may be fabricated from a cylindrical stock, machined and cut-away to provide a circular cross-section at one end, a semi-circular cross-section at the opposite end in providing a flat landing, and a gradual slope from the flat landing upwardly to the opposing end. With the opposing ends of the member then being secured within knob receptacles of circular cross-section, alternate "pushing" or "pulling" of the respective knob operates to cause the latch assembly to ride up along the grade slope in retracting the latch bolt. At the same time, rotation of either knob operates, as conventionally, in imparting the "twist" action to produce the typical spring-urging to retract the latch, as well. As will be understood, the described latch assembly will also be seen to operate in this fashion even where the opening of the door is attempted to be attained by a combined "push-twist" or "pull-twist" action.

BRIEF DESCRIPTION OF THE DRAWINGS

These and other features of the present invention will be more clearly understood from a consideration of the following description, taken in connection with the accompanying drawing, in which.

DETAILED DESCRIPTION OF THE DRAWINGS

Figure 1:
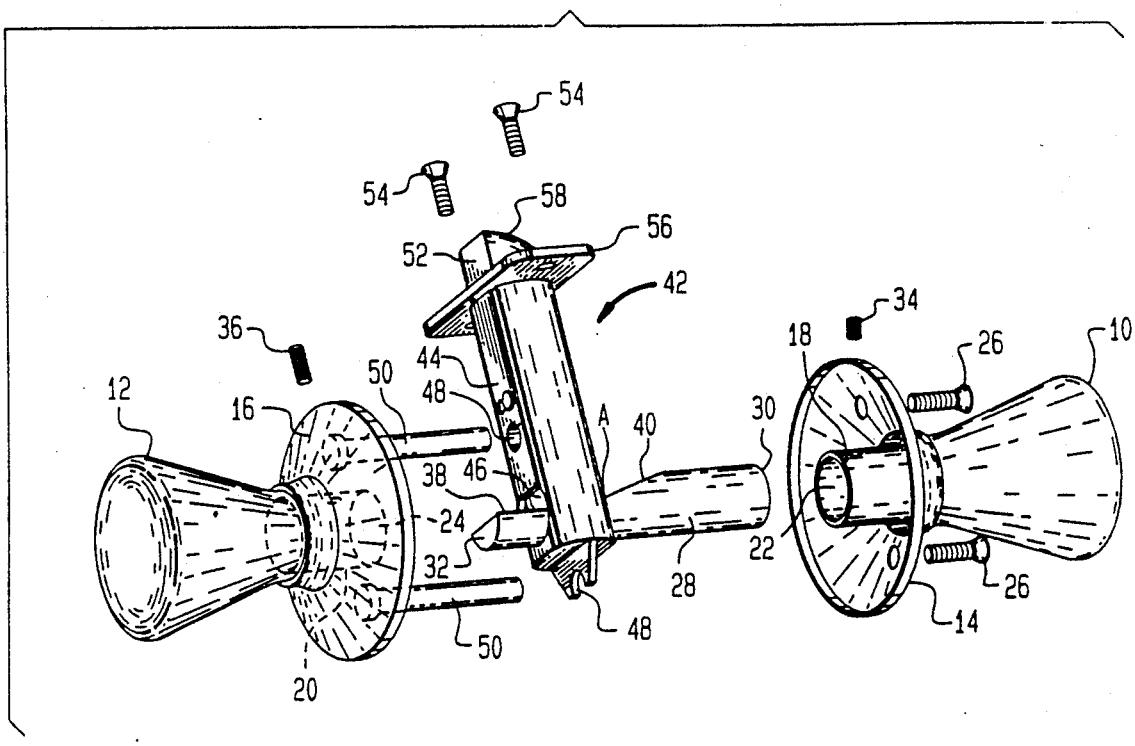
FIG. 1 is an exploded, dis-assembled view of the push-pull or twist door knob/handle of the invention constructed in accordance with a preferred embodiment.
Figure 2:
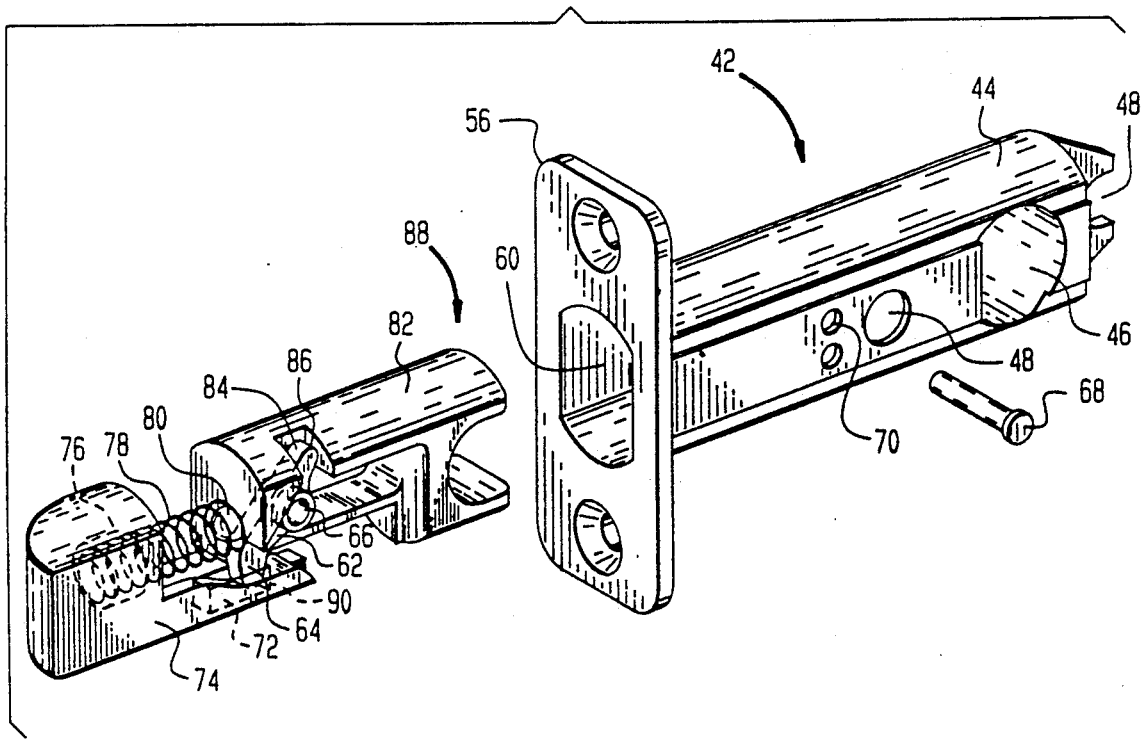
FIG. 2 illustrates the latch bolt mechanism operative with the preferred embodiment in providing the spring-urging.
Figure 3:
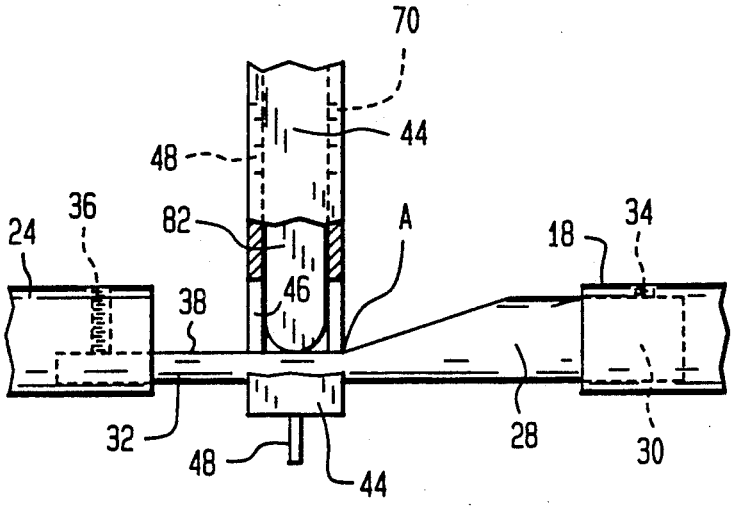
Figure 4:
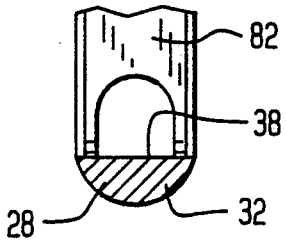

Referring to FIG. 1, reference numeral 10 identifies the knob 10 that would be on the outside of a door (not shown) which is to be opened by swinging inwardly, while reference notation 12 identifies the knob on the inside of the door as the door would be opened into a room, for example. A pair of shields 14, 16 surround the knobs 10, 12, along their lengths 18, 20, of a circular cross-section 22, 24 extending inwardly of the lock compartment of the door in conventional manner, and so as to be secured thereto by appropriate screws, or similar means, 26 positioned along the shields 14, 16. A member 28 is shown as being of generally cylindrical configuration, having a circular crosssection as at the end 30, but being machined and cut-away to have a semi-circular cross-section at the end 32. A first Allen screw 34 extends through the knob length 18 to fixedly secure the member 28 in place at its end 30, while a second Allen screw 36, of greater overall length than the screw 34 extends through the length 20 so as to bear against the end 32 in holding it in place. As will be seen, the member 28 has a generally "flat" portion 38, and a sloping-grade portion 40 along which the latch mechanism 42, at FIG. 2, is allowed to ride. For purposes of this exploded, perspective view of FIG. 1, it is sufficient to note that latch mechanism 42 incorporates a housing 44 having an aperture 46 to receive the member 28 and an additional portion 48 to receive a centering pin 50 extending from the knob shield 16. The latch bolt is shown by reference numeral 52, and a pair of screws 54 employable to secure the mechanism 42 to the door jamb plate 56 upon the door (not shown). As will become clear from the description of FIG. 2, the latch mechanism 42 quiescently is positioned proximate to the point A on the member 28 where the flat and sloping portions 38, 40 join, and with the latch bolt 52 having its bevelled end 58 generally extended. As will also be seen, twisting of either knob 10, 12 in a clockwise or counterclockwise direction causes the latch bolt 52 to retract inwardly, as is conventional. But, as will also be seen, pushing on the knob 10 (or a corresponding pulling on the knob 12) causes the latch mechanism 42 to ride upward along the sloping-grade portion 40, to produce the same latch bolt retraction. In such manner, the door can be opened, by any of a twisting of the knob 10, a twisting of the knob 12, a pushing upon the knob 10, a pulling of the knob 12 or in either of a combined "push-twist" or "pull-twist" action.

Referring now to the exploded, disassembled view of FIGURE 2, the latch housing 44 is provided with an apertured channel 60 along its length in receiving the remaining component parts of the latch mechanism 42. One such component part 62 is provided with a "hook extension" at its lower end, and is apertured, as at 66, to receive a pin 68 which traverses its entire thickness in passing through an aperture 70 in the housing 44 so as to exit at an opposing aperture of the housing 44 (not shown), in securing all the component parts in place within the housing 44.

As shown, the hook extension 64 fits within the longitudinally extending slot 72 at the bottom end of the component part 74 which forms the latch bolt 52. Such second component part 74 also is configured with an aperture 76 to receive one end of a helical spring 78, the opposite end of which is configured to encircle a protruding nib 80 of a third component part 82. A slot 84 is provided within the part 82 so as to receive a bearing extension 86 of the component part 62, in allowing relative movement between the component parts 74, 82 as the spring 78 is compressed and alternatively released, as the hook extension 64 correspondingly slides to the left, or to the right, as shown within the longitudinal slot 72.

As will also be noted, the end of the component part 82 remote from the bearing extension 86 is of a generally U-shape configuration, and with the relative lengths of the components parts 74 and 82 being selected in accordance with the length of the latch housing 44 so as to bring the U-shaped configuration 88 in the vicinity of the latch-housing aperture 46. As will be appreciated, with the pin 68 securing the component part 62 in position within the housing 44, any movement of the component part 82 caused by a pressure upon the U-shape configuration 88 causes a rotating action (counter-clockwise) of the component part 62, whereby the hook extension 64 bears against the sidewall 90 of the longitudinal slot 72, in retracting the component part 74 tothe right (as shown in the drawing), against the resistance of the spring 78. Continuing pressure applied against the U-shape configuration 88 produces a further counter-clockwise rotation of the hook extension 64 and a continuing right-ways linear motion of the component part 74, thereby retracting fully the latch bolt 52 and its bevelled end 58.

As will also be seen in FIG. 2, such pressure upon the U-shaped configuration 88 of the component part 82 is produced by the rotative-action accorded to the member 28 by means of the twisting of the knobs 10, 12, and because a U-shaped configuration is provided, can result in retraction of the component 74 and the latch bolt 52 by a clockwise twisting of the knobs 10, 12 (which is the normal movement in trying to open a door), or by a counter-clockwise twisting as well. As will also be apparent, the pressure exerted upon the U-shaped configuration 88 results as well where the member 28 is linearly moved so as to cause the U-shaped configuration 88 to ride up along the sloping grade portion 40—either by a pushing upon the knob 10, or by a pulling of the knob 12. In either case, a left-wise motion is produced upon the component part 82, causing the side wall 86 of the slot 84 to force a rotation of the bearing extension 86 of the component part 62 in producing a corresponding force upon the side wall 90 of the slot 72 in retracting component 74, its latch bolt 52 and its bevelled end 58.

In accordance with a preferred construction of the embodiment of the invention, a gradual slope of approximately 22° was provided between the portions 38, 40, and with the flat portion 38 having an approximate length of ⅝", the grade portion 40 then being approximately 1 ¼" in length. Pushing-in on the knob 10—as when one tries to enter a room, causes the latch mechanism 42 to ride up the grade 40, in retracting the latch bolt 52; correspondingly, pulling-on the knob 12—as when trying to open inwardly a closed door also causes the latch mechanism 42 to ride up along the grade 40, in retracting the latch bolt. Likewise, rotating the knobs 10, 12, either in a clockwise or in a counter-clockwise direction, to enter or leave the closed room by moving the door, also causes a left-wise motion of the U-shaped configuration 88 and the resultant rotation about the pins 68 and 70 as a fulcrum in retracting the component part 74 and the latch bolt 52, as well. In such manner, the door, or door panel, can be opened easily through the usual twist-action of the knob/handle, or by a pushing or pulling action by those who may be handicapped, suffer from arthritis, or merely have their hands full when attempting to open the door or panel.

While there has been described what is considered to be a preferred embodiment of the present invention, it will be appreciated by those skilled in the art that modifications can be made without departing from the scope of the teachings herein. Thus, whereas Applicants have described the invention as operative with a "tapered" shaft member to produce the action to retract the latch bolt, alternative ways of employing rotating gears, for example, may be incorporated in providing similar situations and results. Other provisions may be conceived of, as well, in providing a door knob/handle mechanism which permits opening of the door through the mediums of pushing-in, pulling-out, or twisting the door knob/handle either clockwise or counter-clockwise, or by a combination of "push-twist", "pull-twist" movements. And, as will be readily apparent, all these actions will be seen to follow whether the door knob/handle mechanism of the invention is installed as a replacement for an already existing door knob construction, or is included as part of an original installation to begin with For at least such reason, therefore, resort should be had to the claims appended hereto for a true understanding of the scope of the invention.

We claim:

1. Apparatus for opening a hinged door by a pair of knobs located on either side thereof, comprising:

first and second knobs each having a tubular extension extending therefrom;

a shaft member having first and second opposing ends, an intermediate portion and a longitudinal axis, said first end having a flat camming surface lying in a plane parallel to said longitudinal axis and being of a uniform cross section, said intermediate portion having a flat camming surface inclined to said axis, each said end telescopically fitted within one of said tubular extensions on said pair of knobs;

means for securing said extensions on said first and second opposing ends;

a latch bolt;

camming means coupled between said shaft member and said latch bolt for cooperating with said flat camming surfaces on said shaft member for actuating said bolt to a retract position upon rotation of either of said pair of knobs, and for actuating said bolt to said retract position upon pushing on one of said pair of knobs and upon pulling of the other of said pair of knobs, and for permitting said shaft member to freely slide with respect to said camming means while preventing actuation of said bolt by said shaft member upon pulling on said one of said pair of knobs and upon pushing on said other of said pair of knobs; and an elongated cartridge, having substantially a uniform cross section, housing said latch bolt and said camming means, said cartridge having an opening at one end through which said latch bolt extends when not in said retract position and a passage near said opposite end for receiving said shaft member and an end of said camming means.

2. The apparatus of claim 1 wherein said shaft member has a first end of cross-sectional configuration corresponding to that of said tubular extension of a first one of said pair of knobs into which said first end is fitted, and wherein said shaft member has a second end of cross-sectional configuration different from that of said tubular extension of a second one of said pair of knobs into which said second end is fitted.

3. The apparatus of claim 2 wherein said first end of said shaft member is of a circular cross-sectional configuration and wherein said second end of said shaft member is of a semi-circular cross-sectional configuration.

4. The apparatus of claim 3 wherein said shaft member incorporates a flat surface portion extending linearly from said second end to a point, and wherein said shaft member also incorporates a sloping surface portion extending upwardly from said point towards said first end.

5. The apparatus of claim 4 wherein said camming means is biased against said shaft member about said point and is movable along said sloping surface portion for actuating said latch bolt to said retract position.

6. The apparatus of claim 5 wherein said camming means is coupled with said shaft member to move upwardly along said sloping surface portion upon pushing on said one of said pair of knobs and upon pulling of said other of said pair of knobs.

7. The apparatus of claim 5 wherein said camming means is coupled with said shaft member to remain substantially at said point upon rotation of either of said pair of knobs for actuating said bolt to said retract position.

8. A door fastener comprising:

a housing;

a latching member located in said housing being selectively extensible and retractable relative to said housing;

a camming member located in said housing including means for extending and retracting said latching member when said camming member is moved relative to said housing;

a camming shaft having cam surface means for selectively causing said camming member to move relative to said housing upon rotation of said shaft in either direction and upon linear movement of said shaft with respect to said housing in one direction and for permitting said camming shaft to move linearly with respect to said camming member in the direction opposite to said one direction while averting movement of said camming member by said camming shaft;

a first door knob having a tube telescopically received over one end of said shaft and including adjustable means for securing said tube to any one of a plurality of positions on said one end of said shaft;

a second door knob having a tube telescopically received over the opposite end of said shaft and including an adjustable means for securing said tube to any one of a plurality of positions on said opposite end of said shaft;

first and second shields slidably and rotatably received said first knob and said second knob, respectively; and securing means joined to said shields and extending into abutment with said housing for securing said shields to each other and to a door and for preventing rotation of said housing upon rotation of said shaft.

9. A door fastener comprising:

a latch bolt housing having an axial bore with an axial opening at one end of said housing, and a transverse passage communicating with said bore and passing transversely through said housing near the opposite end thereof;

a latch bolt mounted in said bore and having a latching member and a camming member slidably received in said bore, said bolt further including a spring biasing said latching member and said camming member away from each other such that a portion of said latching member protrudes from said axial opening and a portion of said camming member protrudes into said passage, and said bolt further including means for causing said latching member to be retracted into said bore in response to movement of said camming member toward said latching member;

an elongated shaft having a narrow end, a wide end and an intermediate portion of variable width extending between said narrow end and said wide end, said shaft being slidably and rotatably received in said passage with said camming member biased by said spring into camming relationship with said shaft, and wherein said shaft has camming surface means for sliding said camming member in said bore in response to rotation of said shaft and in response to sliding of said shaft in said passage in a first direction, and wherein said shaft is free to slide in a direction opposite to said first direction while averting movement of said camming member by said shaft;

a first door knob having a tube telescopically received over said wide end of said shaft and including adjustable means for securing said tube to any one of a plurality of positions on said wide end;

a second door knob having a tube telescopically received over said narrow end of said shaft and including an adjustable means for securing said tube to any one of a plurality of positions on said narrow end of said shaft;

first and second shields slidably and rotatably receiving said first knob and said second knob, respectively; and securing means joined to said shields and extending into abutment with said housing for securing said shields to each other and to a door and for securing said housing with respect to said shields.

* * * * *